United States Patent [19]

Collot et al.

[11] Patent Number: 4,803,601

[45] Date of Patent: Feb. 7, 1989

[54] MOTOR VEHICLE HEADLIGHT, SUITABLE FOR EMITTING A BEAM LIMITED BY A CUT-OFF, AND INCLUDING A MODIFIED REAR PORTION

[75] Inventors: Patrice Collot, Pantin; Bernard Luciani, Paris, both of France

[73] Assignee: Cibie Projecteurs, France

[21] Appl. No.: 140,241

[22] Filed: Dec. 31, 1987

[30] Foreign Application Priority Data

Dec. 30, 1986 [FR] France ..... 86 18341
Dec. 30, 1986 [FR] France ..... 86 18342

[51] Int. Cl.[4] ..... F21V 7/00
[52] U.S. Cl. ..... 362/80; 362/346
[58] Field of Search ..... 362/80, 346, 349

[56] References Cited

U.S. PATENT DOCUMENTS 4,420,801 12/1983 Reiling et al. ..... 362/346 X
4,447,865 5/1984 Van Horn et al. ..... 362/346 X
4,506,315 3/1985 Maekawa et al. ..... 362/346 X

FOREIGN PATENT DOCUMENTS 2528537 6/1982 France .
2583139 6/1985 France .

*Primary Examiner*—Allen M. Ostrager

[57] ABSTRACT

A motor vehicle headlight of the type suitable for emitting at least one beam that is delimited by a top cut-off and that includes an approximately central concentration spot, the headlight comprising: a filament lamp (100); a reflector (200); and a closure glass (300); the headlight including the improvements whereby said reflector comprises: at least two lateral zones (202, 202') that form small images of the filament defining said concentration spot and forming said cut-off; and a central zone (201, 201, 203, 203') which reflects the light rays emitted by the filament to cause them to converge in a region at a substantial distance from the closure glass while simultaneously forming large filament images which are spread out below said cut-off; with said lateral zones and said central zone joining one another with second order continuity in two essentially vertical planes that are parallel to a central optical axis of the headlight and are disposed on either side thereof.

18 Claims, 18 Drawing Sheets

FIG. 11
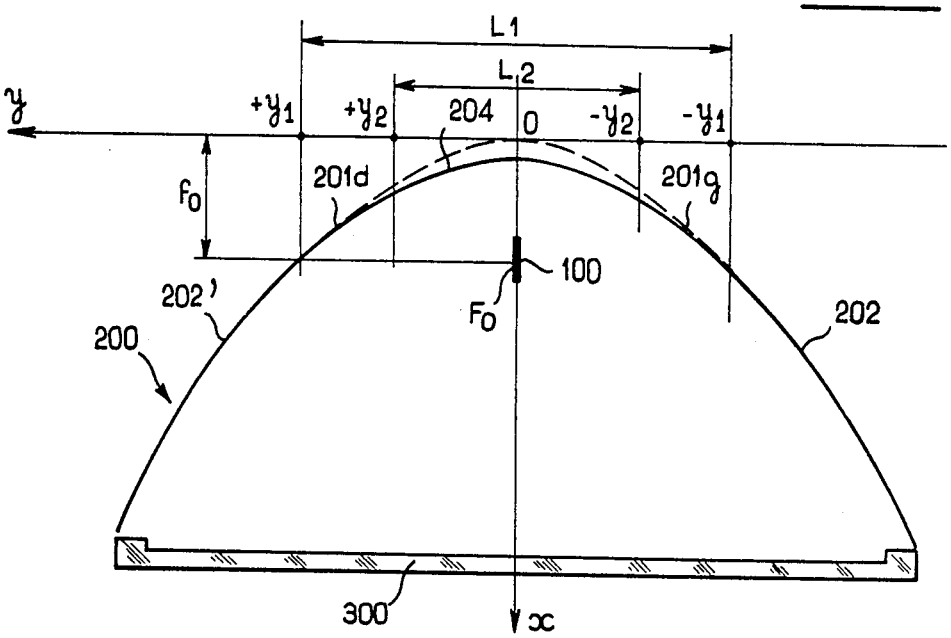
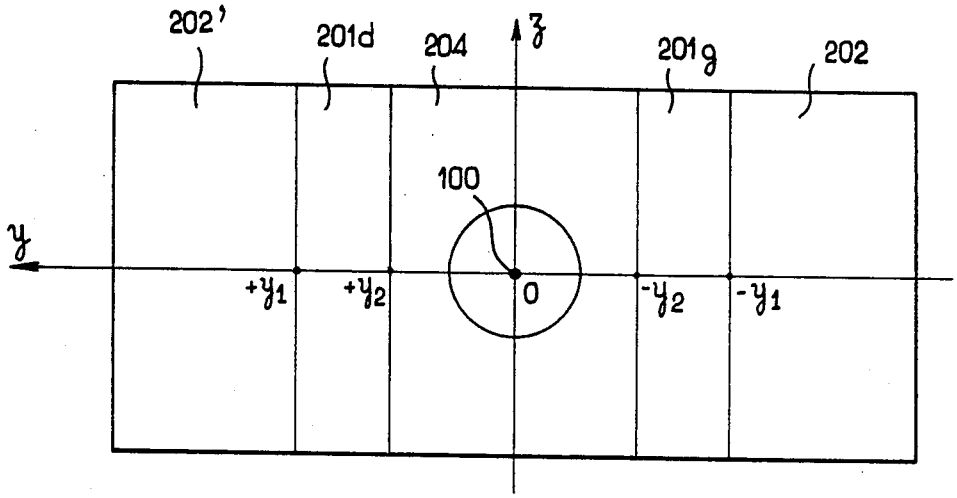
FIG. 12

MOTOR VEHICLE HEADLIGHT, SUITABLE FOR EMITTING A BEAM LIMITED BY A CUT-OFF, AND INCLUDING A MODIFIED REAR PORTION

The present invention relates to motor vehicle headlights suitable for delivering one or more light beams, with at least one of the beams being limited by a cut-off and constituting a dipped beam or a foglight beam.

BACKGROUND OF THE INVENTION

The way such a cut-off is defined varies depending on the regulations in force in various different countries; however, for dipped beams there are two main types of standard.

A first very widespread standard is the European standard to which the light beam is delimited by a horizontal half-plane situated to the left of the horizontal axis of the headlight (for righthand drive), and by a half-plane situated to the right of the same axis, and inclined at a small upwards angle of 15° from said axis.

For further details concerning this standard, reference should be made to the Official Journal of the European Community, number L 262, dated Sept. 27th, 1976, page 108.

A commonly used headlight capable of emitting a main beam and a dipped beam of the type specified above comprises a closure glass having elements for deflecting light by refraction, a parabolic reflector, and a lamp comprising two axially disposed filaments, with the rear filament being used for the main beam, and with the front filament which is provided with a masking cup being used for the dipped beam.

The focus of the reflector is situated between the two filaments so that light rays from the dipped beam as reflected from the rear portion of the reflector are initially converging rays.

Unfortunately, this convergence produces a very high concentration of light at the center of the glass together with considerable heating. In practice, if the glass is made of transparent plastic material it will inevitably become deformed.

This phenomenon is accentuated when the closure glass is at an increased distance from the lamp and the reflector, for design reasons.

Alternatively, in order to satisfy the other very widespread standard which is applicable in the United States of America and which is referred to as SAEJ 579C, it may be required that the dipped beam should lie below a cut-off limit defined by two horizontal half-planes which are at slightly different heights on either side of the forward axis.

Further, in order to obtain high light yield, the Assignees have proposed, in their French patent application published under the No. 2 583 139, a headlight which provides a dipped beam of this type and which has a reflector which is complex in shape and which co-operates with an axial filament and which is suitable for forming images of the filament below the cut-off, thereby making it possible to use smaller focal lengths and consequently to recover a very much greater quantity of light flux.

Finally, French patent application No. 86/07 461 filed May 26, 1986 in the name of the present Assignees, describes a dipped beam headlight whose beam also has a cut-off of this type, with the concentration spot of said beam being offset to the right from the headlight axis by a novel definition of the reflecting surface, i.e. without requiring any corresponding tilting of the reflector and of the lamp.

However, in all of these headlights satisfying the American standard, there still remains the problem of the center of the glass becoming heated, and this is due to the fact that the rays reflected from the rear portion of the reflector converge on a point situated close to the glass.

Finally, mention should be made of foglights which are generally obtained using similar constructions to those used for American cut-off dipped beams, and which therefore generally suffer from the same drawbacks.

Thus, regardless of the type of cut-off beam that may be desired, and regardless of the practical techniques used to obtain it, prior art reflectors all tend to provide excessive light concentration in the center of the closure glass.

The prior art also includes the Assignees' French patent No. 2 528 537 which describes a European standard dipped beam headlight having a dipped filament provided with a masking cup, a reflector of the parabolic type with its focus in the vicinity of the filament, and a closure glass. In this prior patent, the rear portion of the reflector is modified in particular to avoid excessive light concentration in the center of the glass. More precisely, the rear portion is a paraboloid like the remainder of the reflector, but at least one of its parameters is different.

Although such a solution does indeed reduce heating in the center of the glass, it nevertheless suffers from the drawback whereby the surface of the reflector than has zero order or first order discontinuities which complicate the manufacture thereof and which give rise to optical defects in the resulting beam.

Another drawback of the headlight described in this prior patent is that it is exclusively limited to filaments associated with a masking cup. Using a reflector with a modified parabolic rear portion in conjunction with a filament that does not have a masking cup would have disastrous consequences on the formation of the cut-off.

The present invention thus seeks to mitigate these drawbacks of the prior art and to provide a headlight which is suitable for emitting a beam including a cut-off from a filament which may optionally be provided with a masking cup, and which does not suffer from any problem of excessive heating in the center of the glass, without degrading the light yield.

Another aim of the invention is to achieve this result with a reflector which does not have any discontinuities which are observable in zero order or in first order.

A further aim of the invention is to simultaneously provide a cut-off light beam which, in the absence of the closure glass, already has substantial sideways spread, thereby minimizing the sideways spreading that needs to be provided by the closure glass. As explained below, this feature makes it possible to use closure glasses at a very steep slope.

Finally, a subsidiary aim of the present invention is to provide a headlight in which determined zones of the glass have light rays passing therethrough corresponding to images of the filament whose sizes lie within respective given ranges, thereby enabling the glass to influence some of the properties of the beam independently from its other properties.

SUMMARY OF THE INVENTION

To this end, the present invention provides a motor vehicle headlight of the type suitable for emitting at least one beam that is delimited by a top cut-off and that includes an approximately central concentration spot, the headlight comprising: a filament lamp; a reflector; and a closure glass; the headlight including the improvements whereby said reflector comprises:

at least two lateral zones that form small images of the filament defining said concentration spot and forming said cut-off; and a central zone which reflects the light rays emitted by the filament to cause them to converge in a region at a substantial distance from the closure glass while simultaneously forming large filament images which are spread out below said cut-off;

with said lateral zones and said central zone joining one another with second order continuity in two essentially vertical planes that are parallel to a central optical axis of the headlight and are disposed on either side thereof.

BRIEF DESCRIPTION OF THE DRAWINGS

Embodiments of the invention are described by way of example with reference to the accompanying drawings, in which:

FIG. 11 is a diagrammatic horizontal view through a headlight constituting a first variant of said second main embodiment of the invention;

FIG. 12 is a front view of the reflector of the FIG. 11 headlight;

MORE DETAILED DESCRIPTION

Figure 1:
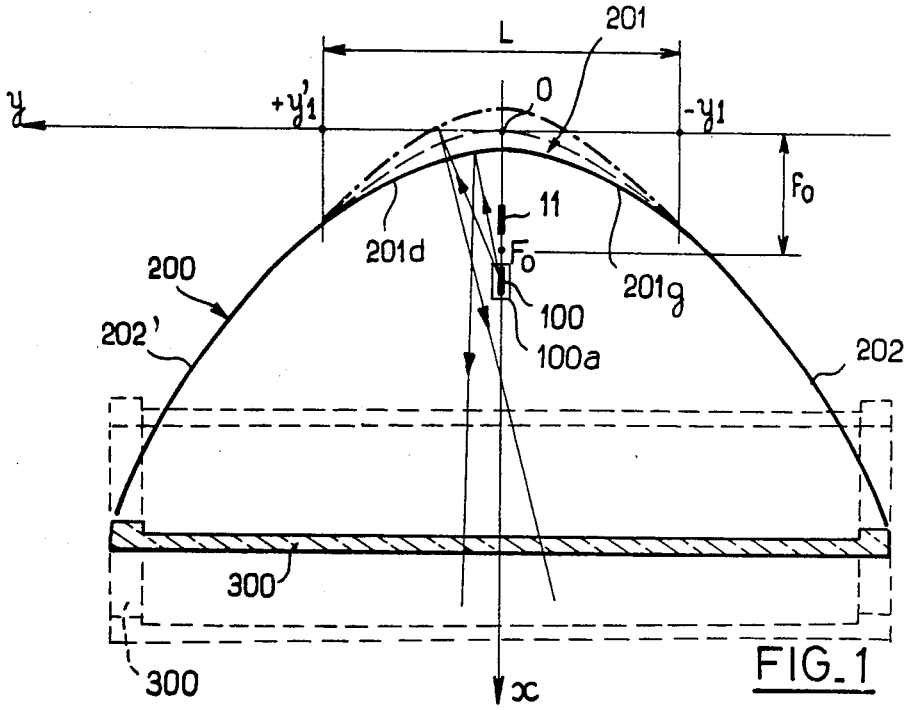
FIG. 1 is a diagrammatic horizontal section through a headlight in accordance with a first main embodiment of the invention.
Figure 2:
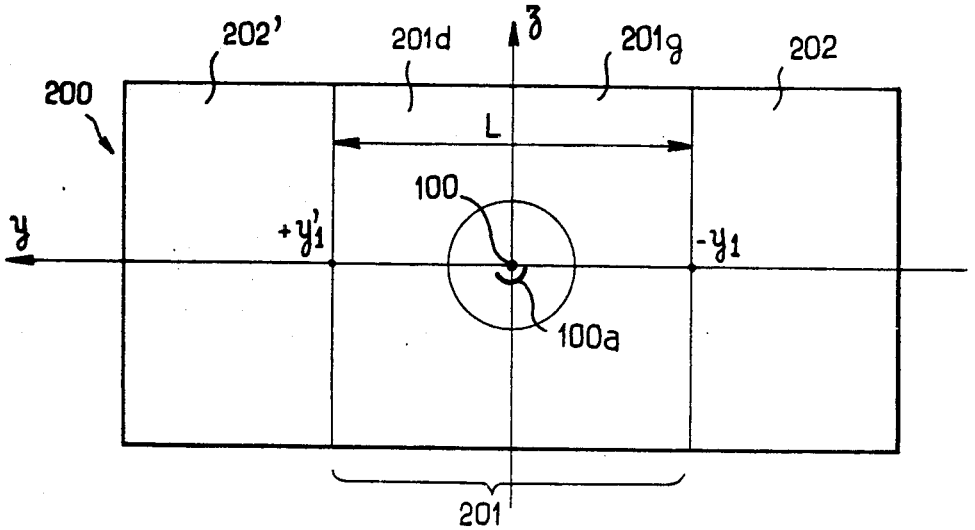
FIG. 2 is a front view of the reflector of the FIG. 1 headlight.

FIGS. 1 and 2 show a main beam and dipped beam headlight in accordance with a first embodiment of the present invention. It comprises a lamp, e.g. of the "H4" type, having an axial main beam filament 110 and an axial dipped beam filament 100 which is partially surrounded, in conventional manner, by a masking cup 100*a*, a reflector 200, and a closure glass 300. The reflector 200 is divided into three zones: 201, 202, and 202' which meet along vertical planes parallel to the optical axis Ox. The zone 201 occupies the rear portion of the reflector and has a width L and has the same height as the reflector. More precisely, the transition plane between the zones 201 and 202' is at a distance $+y'_1$ from the vertical plane xOz containing the optical axis, and the transition plane between the zones 201 and 202 is at a distance $-y_1$ from said plane, where $y_1+y'_1=L$.

The reflecting surfaces of the zones 202' and 202 are both in the form of sections of paraboloids having focal lengths $f'_0$ and $f_0$, about the axis Ox and sharing a common focus $F_0$ situated between the filaments 100 and 110, where the focal lengths $f'_0$ and $f_0$ may be identical or different.

In conjunction with the masked filament 100, these surfaces define a V-shaped cut-off dipped beam.

The reflecting surface of the zone 201 is designed so as to create images of the two filaments of the lamp which are different from those which are conventionally obtained using a reflector such as that described above whose entire surface is in the form of a paraboloid. More particularly, the invention proposes a range of surfaces for the zone 201 serving to define the location of the point of convergence of the highly concentrated light beams emitted by the dipped beam filament 101 and reflected by the zone 201 in the manner desired, said range corresponding to relatively large images of the filament. It should be observed that this modification of the rear portion of the reflector has the essential effect on the light beam of modifying the distribution of the smallest images of the filament as provided by the zones 202 and 202', which smallest images contribute to creating the concentration spot of the beam. In addition, the selected surface has the property of not deteriorating the cut-off.

More precisely, by ensuring that the light rays reflected forwardly from the rear region of the reflector are more convergent, or on the contrary are less convergent, (in either case relative to the conventional convergence which gives rise to a very high intensity of intersecting light rays precisely where the glass is generally situated), it is possible to diminish the light intensity of the central portion of the beam where it passes through the closure glass, thereby making it easier to use closure glasses made of molded transparent plastic without running the risk of deformation by overheating.

In this first embodiment of the reflector, the portion 201g of the reflecting surface of the zone 201 which is situated to the left of the plane xOz (as seen from behind) may satisfy the following equation, in the frame of reference (O, x, y, z) as shown in the drawings:

$$x = \frac{z^2}{4\left[f_0 - \dfrac{\alpha(\alpha f_0 + \frac{1}{2})(|y| - y_1)^2}{1 + \dfrac{y^2}{4f_0^2} + \dfrac{\alpha\alpha_1 y}{f_0}(|y| - y_1) + \alpha^2(|y| - y_1)^2}\right]} + \frac{y^2}{4f_0^2} + \frac{\alpha}{2}(|y| - y_1)^2 \quad (1)$$

where $-y_1 \leqq y \leqq 0$ with:

$f_0$=the focal length of the adjacent paraboloid portion 202;

$\alpha$=the flattening or deepening coefficient of the lefthand portion of the surface;

$\alpha_1 = y/|y|$; and $y_1$=the width of the lefthand portion 201g of the rear zone.

The equation of the righthand portion 201d of the reflecting surface is advantageously the same as above equation (1), however the parameters $f_0$, $\alpha$ and $y_1$ are replaced by parameters $f'_0$, $\alpha'$, and $y'_1$ which may be respectively equal to parameters $f_0$, $\alpha$ and $y_1$, (in which case the reflecting surface is symmetrical overall about the plane xOz) or else different therefrom.

It can be shown that, in the join planes of equation $y=y-y_1$ (between the zones 201g and 203) and $y=-+y'_1$ (in the zones 201d and 202), the above equations make it possible to ensure second order continuity (tangent continuity) between these zones.

In addition, it should be observed that the fact of putting the parameters $\alpha \neq \alpha'$ and $y_1 \neq y'_1$ in the equations for the lefthand and righthand portions of the zone 201 necessarily gives rise to different focal lengths $f_0$ and $f'_0$ not only in the equations (1) for the lefthand and righthand portions of the rear portion 201, but also in the equations for the zones 202 and 202' which are paraboloid in shape as mentioned above, so as to ensure first order continuity between the portions 201g and 201d on the vertical axial plane xOz and also to ensure second order continuity as mentioned above in the planes $y==y_1$ and $y=+y'_1$.

Thus, in this first embodiment of the invention, the reflecting surface of the reflector suffers from a second order continuity defect only in the axial vertical plane xOz.

A first variant of this first embodiment of the invention is described below with reference to FIGS. 3 and 4 and in which the join between the zones 201g and 201d is provided with second order continuity.

In this variant, in addition to the zones 202 and 202' whose surfaces are paraboloids and to the zones 201g and 201d having modified convergence, there is an intermediate zone 204 which is specially intended to provide a connection with second order continuity between the zones 201g and 201d.

With the zones 201g and 201d being as described above, the equation for the lefthand portion of the central transition zone 204 is as follows:

$$x = \frac{z^2}{4\left[f_0 + \dfrac{-\frac{\alpha}{2}(|y| - y_1)^2 - \frac{\alpha_2}{2}(|y| - y_2)^2 - [(\alpha + \alpha_2)|y| - \alpha y_1 - \alpha_2 y_2]^2/f_0}{1 + \dfrac{y^2}{4f_0^2} + \dfrac{\alpha_1 y}{f_0}[(\alpha + \alpha_2)|y| - \alpha y_1 - \alpha_2 y_2] + [(\alpha + \alpha_2)|y| - \alpha y_1 - \alpha_2 y_2]^2}\right]} + \frac{y^2}{4f_0^2} + \frac{\alpha}{2}(|y| - y_1)^2 + \frac{\alpha_2}{2}(|y| - y_2)^2 \quad (2)$$

with $-y_2 \leqq y \leqq 0$ $f_0$, $\alpha$ and $\alpha_1$ being as defined above;

$\alpha_2 = \alpha y_1/y_2$=the connection coefficient;

$y_2$=the width of the lefthand portion of the connection zone 204; and $y_1$=the width of the lefthand portion of the entire rear zone.

As for the righthand portion of the rear zone, its reflecting surface satisfies above equation (2) except that it uses parameters $f'_0$, $\alpha'$, $\alpha'_2$, $y'_1$, and $y'_2$ which may be the same as the parameters $f_0$, $\alpha$, $\alpha_2$, $y_1$, and $y_2$, or which may be different therefrom.

It should be observed that, as in the first embodiment shown in FIGS. 1 and 2, a change in parameters between the lefthand side and the righthand side means that different focal lengths $f_0$ and $f'_0$ are also used, in order to ensure continuity in the join in the axial vertical plan xOz.

Figure 3:
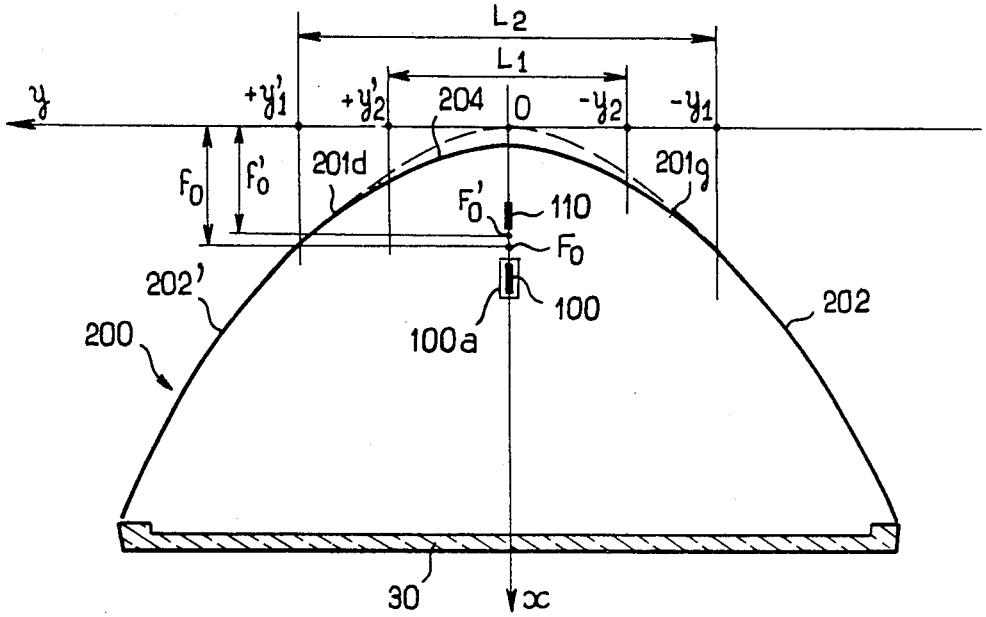
FIG. 3 is a diagrammatic horizontal section showing a first variant of the first embodiment of the invention.
Figure 4:
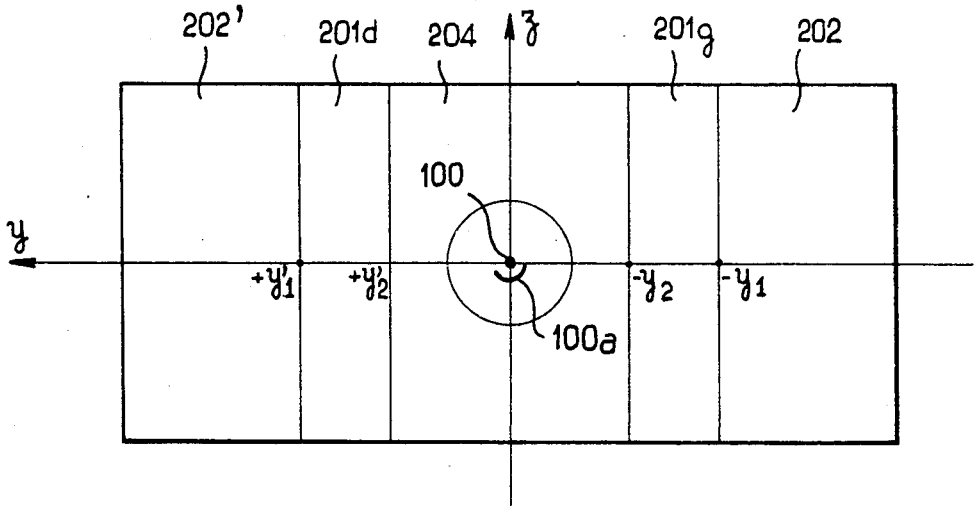
FIG. 4 is a front view of the reflector of the FIG. 3 headlight.
Figure 5:
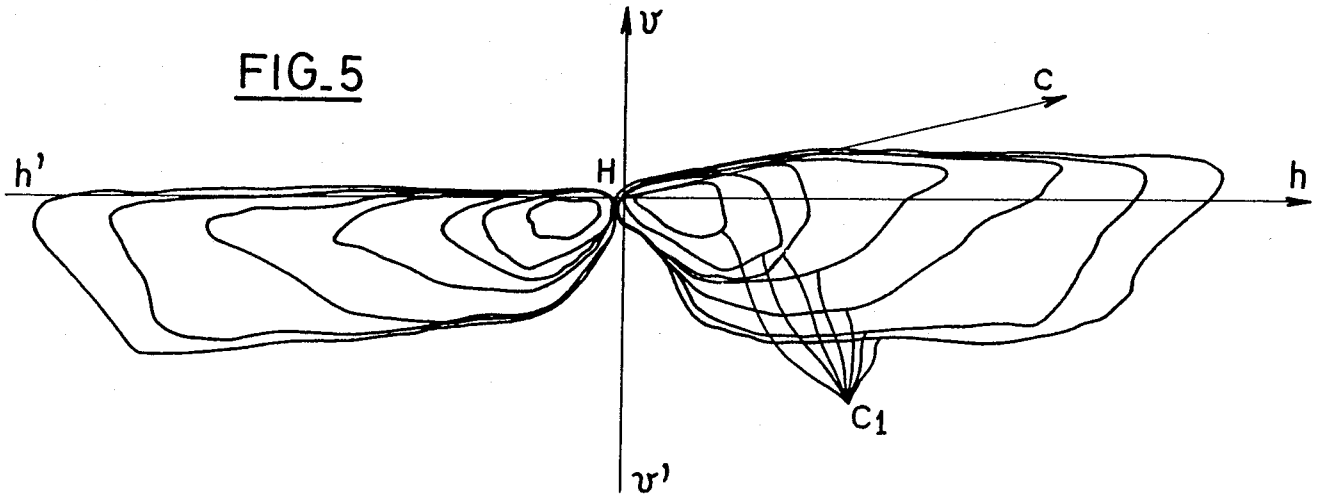
FIG. 5 is a set of isocandela curves showing the light distribution on a projection screen as provided by the dipped beam from the headlight shown in FIGS. 3 and 4 without its closure glass.

FIG. 5 is a set of isocandela curves $C_1$ showing the distribution of light from the dipped beam provided by the headlight of FIGS. 3 and 4 without its closure glass. This figure is to be compared with the narrow beam obtained with a conventional headlight having a parabolic reflector of the same dimensions. It may be observed that the fundamental effect on which the present invention is based, i.e. reducing heating in the center of the closure glass, is obtained by virtue of a suitable selection of the equations defining the central reflecting zone 201 without spoiling the formation of the cut-off, and that this also gives rise to a greater spread of the beam, thereby advantageously reducing the amount of sideways deflection which would otherwise have to be performed by refraction elements in the closure glass, as described in detail below.

It can also be seen in FIG. 5 that the horizontal half cut-off h'H and the sloping half cut-off Hc are defined over a considerable length with good accuracy.

Figure 6:
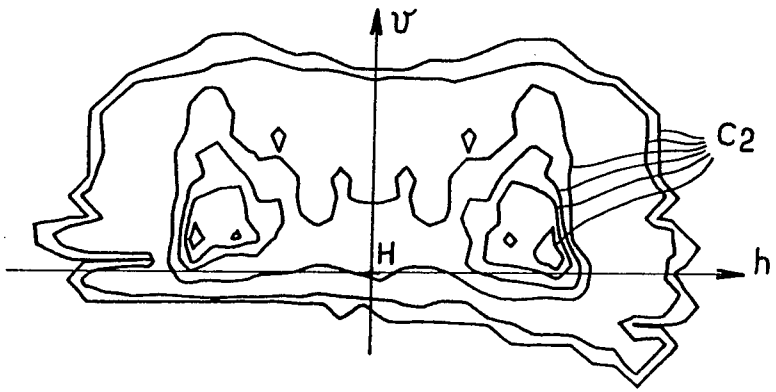
FIG. 6 is a set of isocandela curves showing the light distribution at the glass of the dipped beam from the headlight of FIGS. 3 and 4.

FIG. 6 is a set of isocandela curves $C_2$ measured at the closure glass showing the distribution of light from the dipped beam provided by the headlight of FIGS. 1 and 2; it can be seen that there is a considerable reduction in the concentration in the center of the glass compared with prior art headlights.

Figure 7:
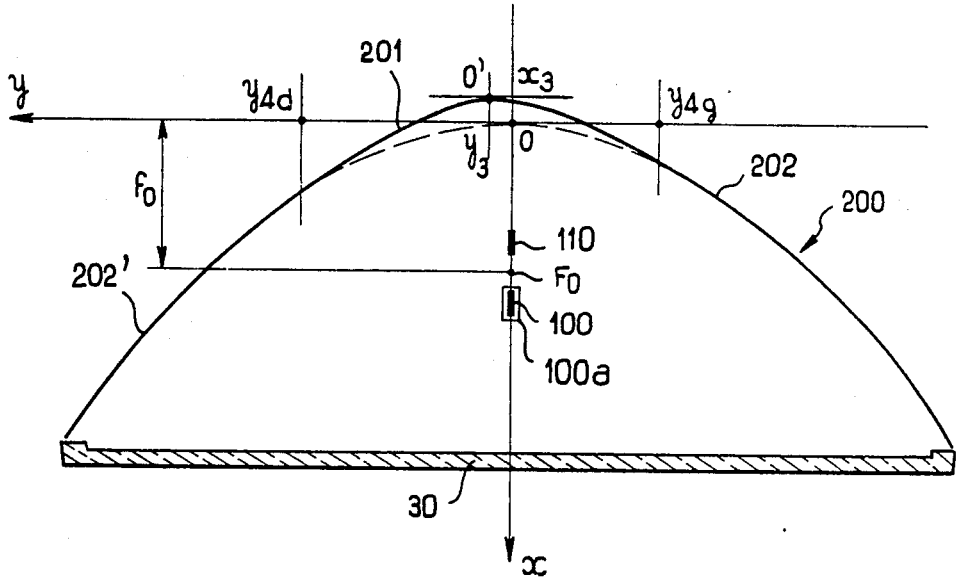
FIG. 7 is a diagrammatic horizontal section showing a second variant of the first embodiment of the invention.
Figure 8:
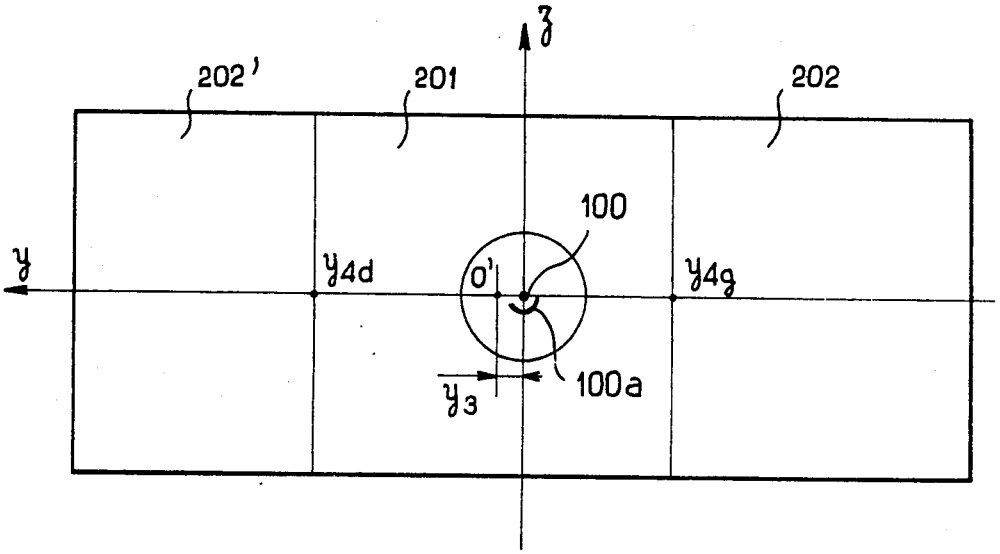
FIG. 8 is a front view of the reflector of the FIG. 7 headlight.

With reference to FIGS. 7 and 8, a second variant of the first embodiment of the invention is now described.

In this variant, the reflector 200 is divided into three zones: 201, 202, and 202' which join in parallel vertical join planes extending parallel to the optical axis Ox of the head-light. The side zones 202 and 202' are portions of paraboloids which in the present example have the same focal length $f_0$ and the same focus position $F_0$. The zone 201 constitutes the rear of the reflector and differs from the conventional paraboloid shape which is shown in dashed lines in FIG. 7. The surface in the zone 201 is governed by a set of parameters illustrated in FIG. 7. These parameters are the following:

- $x_3$ and $y_3$ are co-ordinates in the frame of reference (O, x, y) of the apex O' of the reflector;
- $y_{4d}$ is the horizontal distance between the plane xOz and the transition plane between the zones 201 and 202'; and
- $y_{4g}$ is the horizontal distance between the plane xOz and the transition plane between the zones 201 and 202.

The equation of the reflecting surface of zone 202 is given, for example, by the following equation:

$$x = x_3 + u \cdot [v(y)]^2 + \frac{(1 + A^2)z^2}{4(f_0 - x_3 - u \cdot [v(y)]^2 + Ay)} \quad (3)$$

where $$u = (y_4^2/4f_0) - x_3,$$

where $y_4 = y_{4d}$ if $y \geqq y_3$ and $y = y_{4d}$ if $y \leqq y_3$;

$$v = \delta + (y_4 \cdot \Delta y/|y_4 \cdot \Delta y|)\sqrt{\delta^2 + (y - y_3)/\Delta y},$$

where $\Delta y = y_3 - (4f_0x_3)/y_4$ and $\delta = (\frac{1}{2})(1 - (y_4 - y_3)/\Delta y)$ and $$A = u \cdot v(y)/(\Delta y \cdot (v(y) - \delta))$$

The various parameters used by the above equation have the following influences:

- the sign of $x_3$ determines the direction in which the rear of the reflector is changed compared with a conventional paraboloid reflector; if $x_3$ is negative, then the rear of the mirror is made deeper (as shown) and the light rays of the beam converge more than otherwise in the sideways direction; if $x_3$ is positive, then the rear of the mirror is flattened and the rays converge less, and may even diverge;
- the value of $x_3$ determines the magnitude of one or other of the above two phenomena;
- the parameters $y_3$ serve to offset the peak of the reflector to the right ($y_3>0$) or to the left ($y_3<0$) (compared with the beam emission direction of the beam), so as to give rise to an asymmetrical beam image of considerable width, thereby enhancing illumination of one side or the other of the beam; and
- the parameters $y_{4g}$ and $y_{4d}$ serve to extend the zone 201 which defines the modified rear of the reflector to a different extent on the left and on the right.

A reflector in accordance with this second variant embodiment of the invention is advantageous in that it provides second order continuity at all points on its surface. As a result it is easier to manufacture and it does not suffer from optical defects.

The light distribution of the dipped beam provided by this headlight is substantially identical to that shown in FIG. 5, but with the above-mentioned advantages. Thus, it is observed that the beam obtained is already very wide before being subjected to any sideways spreading by the glass.

Figure 9:
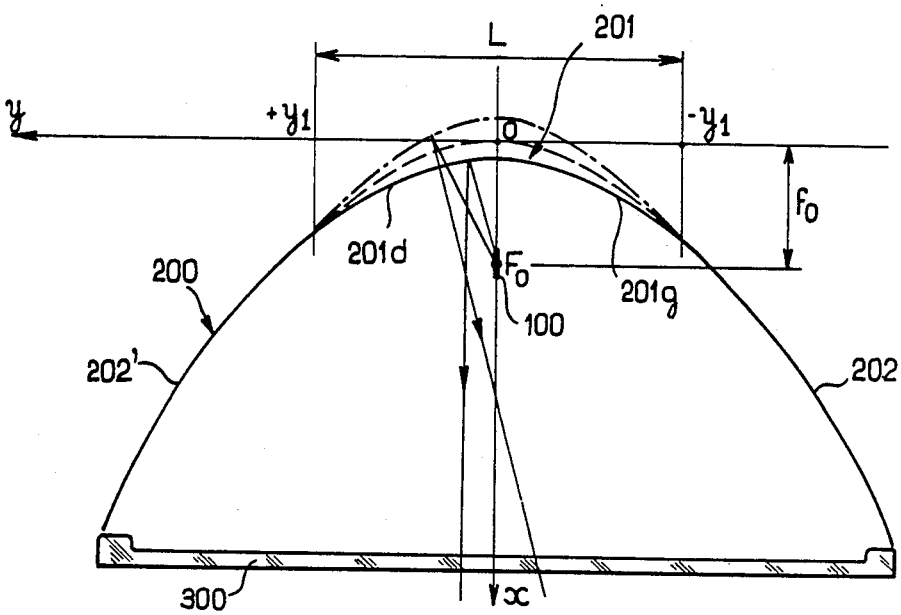
FIG. 9 is a diagrammatic horizontal section through a headlight in accordance with a second main embodiment of the invention.
Figure 10:
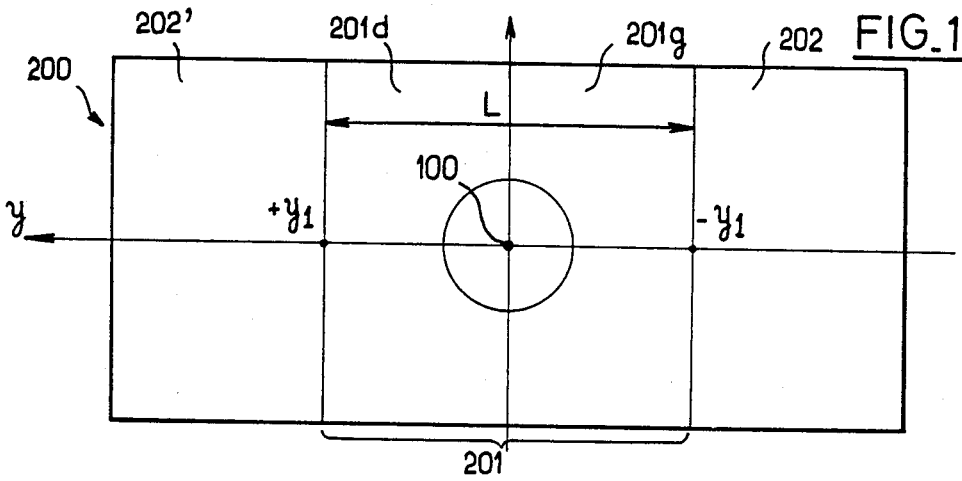
FIG. 10 is a front view of the reflector of the FIG. 9 headlight.

Reference is now made to FIGS. 9 and 10 which are diagrams of a dipped beam headlight in accordance with a second main embodiment of the invention and intended to provide a beam that satisfies the standard applicable in the United States of America as mentioned in the introduction.

This embodiment comprises a lamp (not shown) provided with an axial filament of length 2×l and having no masking cup. The filament 100 is offset upwardly from the axis Ox of the headlight so as to lie tangentially to said axis, as shown.

A reflector 200 is divided into three zones 201, 202, and 202' which join along vertical planes that extend parallel to the optical axis Ox.

Finally, a closure glass 300 of plastic material intercepts the light beam formed by the lamp/reflector assembly.

The zone 201 of the reflector occupies the rear region thereof and has width L and height equal to the height of the reflector. More precisely, the transition plane between the zones 201 and 202' is at distance $+y_1$ from the vertical plane xOz containing the optical axis, and the transition plane between the zones 201 and 202 is at distance $-y_1$ from said plane, such that $2_{y1}=L$.

The reflecting surface of the zones 202 and 202' is identical to that described in French patent application published under the No. 2 583 139 in the name of the present Assignees, i.e.:

$$x = \frac{z^2}{4\left[f_0 - \frac{\epsilon l}{1 + \frac{y^2}{4f_0^2}}\right]} + \frac{y^2}{4f_0} \quad (4)$$

where:

- (O, x, y, z) represents the orthogonal frame of reference shown;
- $f_0$: the focal length of the base of the reflector;
- l: the half length of the filament 100; and
- $\epsilon$: $z/|z|$.

The reflecting surface of the zone 201 is designed so as to create images of the lamp filament which are different from those which are conventionally obtained in this zone using a reflector whose entire surface matches equation (4) above. More precisely, the invention proposes that the zone 201 should have one of a range of surfaces for determining the convergence of the high concentration light rays reflected by the zone 201 at will, said rays corresponding to relatively large images of the filament. It should be observed that this modification of the rear of the reflector acts on the light beam essentially without changing the distribution of the smaller images of the filament as provided by the zones 202 and 202' which contribute to creating the beam concentration spot while defining the standardized cut-off as specified in the introduction, without spoiling said cut-off. For more detail on this subject, reference may be made to above-mentioned French patent application No. 2 583 139.

More precisely, by making the light rays reflected forwardly from the rear region of the reflector more convergent, or conversely less divergent (compared with the conventional convergence which gives rise to a high intensity of these rays crossing precisely where the glass is normally situated), it is possible to reduce the light intensity of the central portion of the beam where it goes through the closure glass, which makes it possible to use closure glasses made of transparent molded plastic material much more easily without any risk of the glasses being deformed by overheating.

In this second main embodiment of the headlight, the reflecting surface of the zone 201 may satisfy the following equation in the frame of reference (O, x, y, z) as defined above:

$$x = \frac{z^2}{4\left[f_0 + \dfrac{-\Sigma l - \frac{\alpha}{2}(|y| - y_1)^2 - \frac{\alpha'}{2}(|y| - y_2)^2 - [(\alpha + \alpha')|y| - \alpha y_1 - \alpha' y_2]^2 / f_0}{1 + \frac{y^2}{4f_0^2} + \frac{\alpha_1 y}{f_0}[(\alpha + \alpha')|y| - \alpha y_1 - \alpha' y_2] + [(\alpha + \alpha')|y| - \alpha y_1 - \alpha' y_2]^2}\right]} + \frac{y^2}{4f_0} + \frac{\alpha}{2}(|y| - y_1)^2 + \frac{\alpha'}{2}(|y| - y_2)^2 \quad (6)$$

for:

$-y_2 \leqq y \leqq +y_2$ with:

$f_0$, $\alpha$, $\alpha_1$, and $\Sigma$ as defined above;

$\alpha' = \alpha y_1 / y_2$ = the join coefficient;

$y_1 = L_1/2$ = half length of the rear zone 201g, 204, 201d; and $y_2$ = half width of the join zone 204.

As in the basic embodiment, it is possible to make use of different parameters on either side of the plane xOz. In this case, it is necessary to use different basic focal lengths $f_0$ on either side so as to ensure first and second order continuity in the vertical axial plane xOz.

It should be observed that in the above second embodiment, and in its asymmetrical variant, there remains a second order continuity defect between the right and left portions 201g and 201d in the axial vertical plane xOz, i.e. on either side of this plane the tangents to the two surfaces are not identical.

There follows a description, made with reference to FIGS. 11 and 12 of a first variant of this second main embodiment of the invention in which this join between the zones 201g and 201d takes place with second order continuity.

In this variant, in addition to the zones 202 and 202' whose surfaces are the complex surfaces described above and the zones 201g and 201d having modified convergence, the reflector further includes an intermediate zone 204 which is specifically intended to provide a join with second order continuity between the zones 201g and 201d.

With the surfaces of the zones 201g and 201d as defined above, the equation of the surface of the central transition zone 204 is as follows:

$$x = \frac{z^2}{4\left[f_0 + \dfrac{-\Sigma l - \alpha(\alpha f_0 + \frac{1}{2}(|y| - y_1)^2}{1 + \frac{y^2}{4f_0^2} + \frac{\alpha\alpha_1 y}{f_0}(|y| - y_1) + \alpha^2(|y| - y_1)^2}\right]} + \frac{y^2}{4f_0} + \frac{\alpha}{2}(|y| - y_1)^2 \quad (5)$$

for:

$-y_1 \leqq y \leqq +y_1$ with:

$l$ = half length of the filament;

$f_0$ = the focal distance of the reflector base;

$\Sigma = z/|z|$;

$\alpha$ = the coefficient of deepening ($\alpha < 0$) or flattening ($\alpha > 0$);

$\alpha_1 = y/|y|$; and $y_1 = L/2$ = half width of the zone 201.

By using differently parameterized equations (5) for the left and right sides 201g and 201d of the zone 201, it is possible to obtain different convergences for each side. In this case, it is necessary to make use of different focal lengths $f_0$ for the left and right halves, but both of them should correspond substantially to a common focus $F_0$ situated on the axial direction in the center of the filament so as to avoid any first order continuity defect (i.e. a depthwise step) in the vertical axial section xOz of the reflector.

Figure 13:
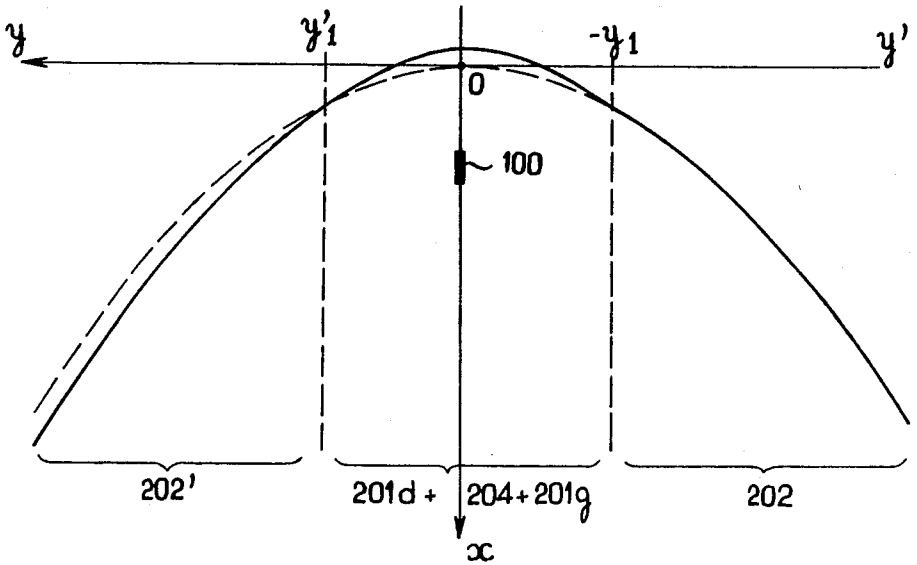
FIG. 13 is a diagrammatic horizontal section through a reflector constituting a second variant of said second embodiment.

FIG. 13 shows an example of the horizontal generatrix line (in the plane xOy) of a reflector in accordance with this second variant embodiment. This line should be compared with the parabolic horizontal generatrix line shown in dashed lines in the same figure.

Figure 14:
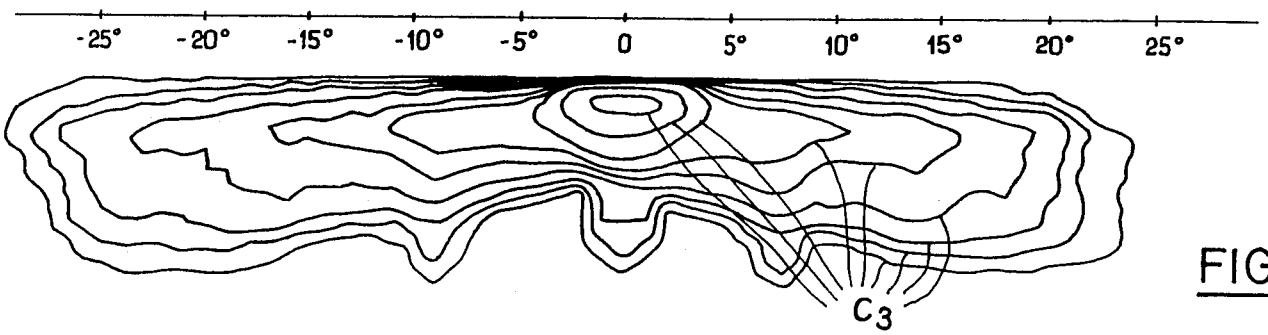
FIG. 14 is a set of isocandela curves at infinity showing the illumination provided by a headlight provided with the FIG. 13 reflector and with its closure glass omitted.

FIG. 14 is a set of isocandela curves $C_3$ showing the light distribution at infinity of a dipped beam obtained with this second variant asymmetric embodiment of the present invention. This figure should be compared with the much narrower illumination obtained under the same conditions, in particular using a reflector of the same size, using a headlight as described in above-mentioned published French patent application No. 2 583 139.

Figure 15:
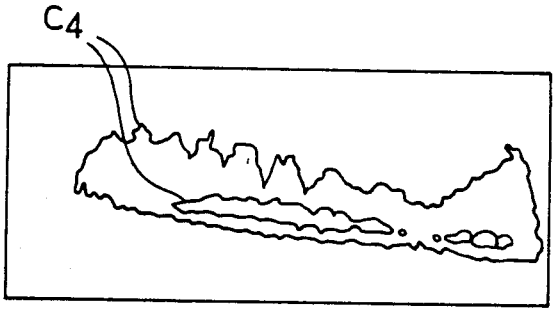
FIG. 15 is a set of isocandela curves showing the light distribution on the closure glass of a headlight in accordance with the present invention.

FIG. 15 is a set of isocandela curves $C_4$ showing the light distribution at the closure glass for a reflector in accordance with the present embodiment of the invention. A very uniform distribution of light can be seen in FIG. 15 with a light concentration zone that is far from being intense, thereby ensuring that the glass is heated to a lesser extent.

Naturally, the modified rear zone of the reflector in accordance with the invention could also be incorporated in a dipped beam headlight with its concentration spot offset as described in French patent application No. 86/07461 filed May 26, 1986 by the present Assignees.

It is recalled here that the reflector of such a headlight is essentially divided into four quarters each having different values for the parameters $\Sigma l$ and $f_0$. The person skilled in the art will understand how to modify above equations (5) and (6) in order to adapt them to a reflector having such a configuration, and in particular how to ensure second order continuity between the modified central zone and the surrounding zones.

Figure 16:
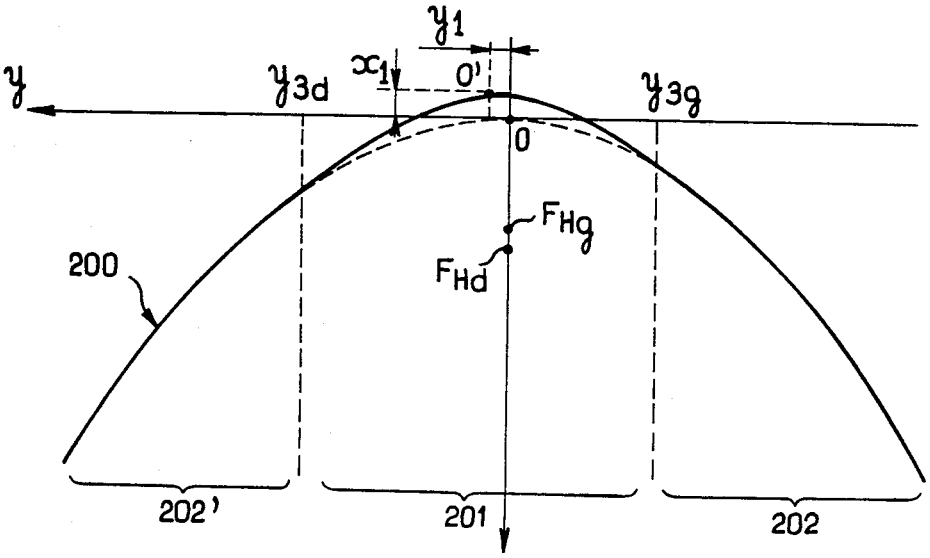
FIG. 16 is a diagrammatic horizontal section through the reflector of a headlight in accordance with a third variant of the second embodiment of the invention.

Reference is now made to FIG. 16 for describing a second variant of the second embodiment of the invention. In this embodiment, the same principles are applied to modifying a zone of the reflector situated between two axial vertical limiting planes in order to modify the convergence of the rays reflected by said zones.

However, the modified surface equation is as follows:

$$x = x_1 + u[v(y)]^2 + \frac{(1 + A^2)z^2}{4(fv - x_1 - u[v(y)]^2 + Ay}$$

for $y_{3g} \leqq y \leqq y_{3d}$ and $$x = \frac{y^3}{4f_H} + \frac{z^2}{4\left[f_0 - \frac{z}{|z|} \cdot \frac{l}{1 + y^2/4f_0^2}\right]}$$

for $y > y_{3d}$ or $y < y_{3g}$ with: $* u = \frac{y_3{}^2}{4f_H} - x_1$ $$* v(y) = \delta + \frac{y_3 \cdot \Delta y}{|y_3 \cdot \Delta y|} \sqrt{\delta^2 + \frac{y - y_1}{\Delta y}},$$

where: $\Delta y = y_1 - \frac{4f_H x_1}{y_3}$ and $\delta = \frac{1}{2}(1 - \frac{y_3 - y_1}{\Delta y}$;

and $* A = \frac{u \cdot v(y)}{\Delta y \cdot (v(y) - \delta)}$ (7)

The various parameters present in equation (7) above have the following meanings or effects:

$x_1$ and $y_1$ represent the offset of the apex O' of the reflector in this embodiment in the horizontal plane xOz compared with the position of the apex of the corresponding non-modified mirror;

$y_3 = y_{3g}$ if $y \leqq y_1$ and $y_3 = y_{3d}$ if $y \geqq y_1$;

with $y_{3g}$ and $y_{3d}$ together determining the width of the modified rear zone 201;

$f_H = f_{Hg}$ if $y \leqq y_1$ and $f_H = f_{Hd}$ if $y > y_1$, where $f_{Hg}$ and $f_{Hd}$ are the basic focal lengths (referenced $f_0$ and $f'_0$ above) of the border zones 202' and 202 of the reflector;

$f_v = f_1$ if $z \geqq 0$ and $f_v = f_{v2}$ if $z \leqq 0$, where $f_{v1}$ and $f_{v2}$ are the focal lengths respectively of the top and bottom vertical half generatrix lines of the reflector in its unmodified state; and $l$ = half length of the filament 100.

These various parameters have the following effects:

the sign of $x_1$ determines whether the rear portion 201 of the reflector is convergent ($x_1 < 0$) or divergent ($x_1 > 0$) for image distribution in a lateral direction;

$y_1$ determines the extent to which the apex O' of the reflector is offset to the right ($y_1 > 0$) or to the left ($y_1 < 0$) so as to cause the wide beam width images formed by the rear zone 201 to be asymmetrical;

$y_{3g}$ and $y_{3d}$ together determine the width of the modified zone 201, and optionally $|y_{3g}| \neq |y_{3d}|$; and $f_{Hg}$ and $f_{Hd}$ determine the position of the concentration spot of the beam in a lateral direction: if $f_{Hg} = f_{Hd}$, then the non-modified zones 202 and 202' of the reflector are symmetrical about a vertical axial plane xOz. However these are the zones which supply the small images of the filament that contribute to building up to constitute the concentration spot. The spot would therefore be centered on the axis of the headlight. Conversely, if $f_{Hd} > f_{Hg}$, then the concentration spot is offset to the right.

The symmetrical version of this headlight in accordance with the invention provides a light beam distribution which is substantially identical to that shown in FIG. 14 for the second basic embodiment of the invention.

It may also be observed that a reflector in accordance with this second variant of the second embodiment of the invention has no first order or second order discontinuity anywhere on its surface.

Further, the light intensity obtained on the glass using this second variant of the second embodiment of the invention is substantially the same as shown in FIG. 15.

Figure 17:
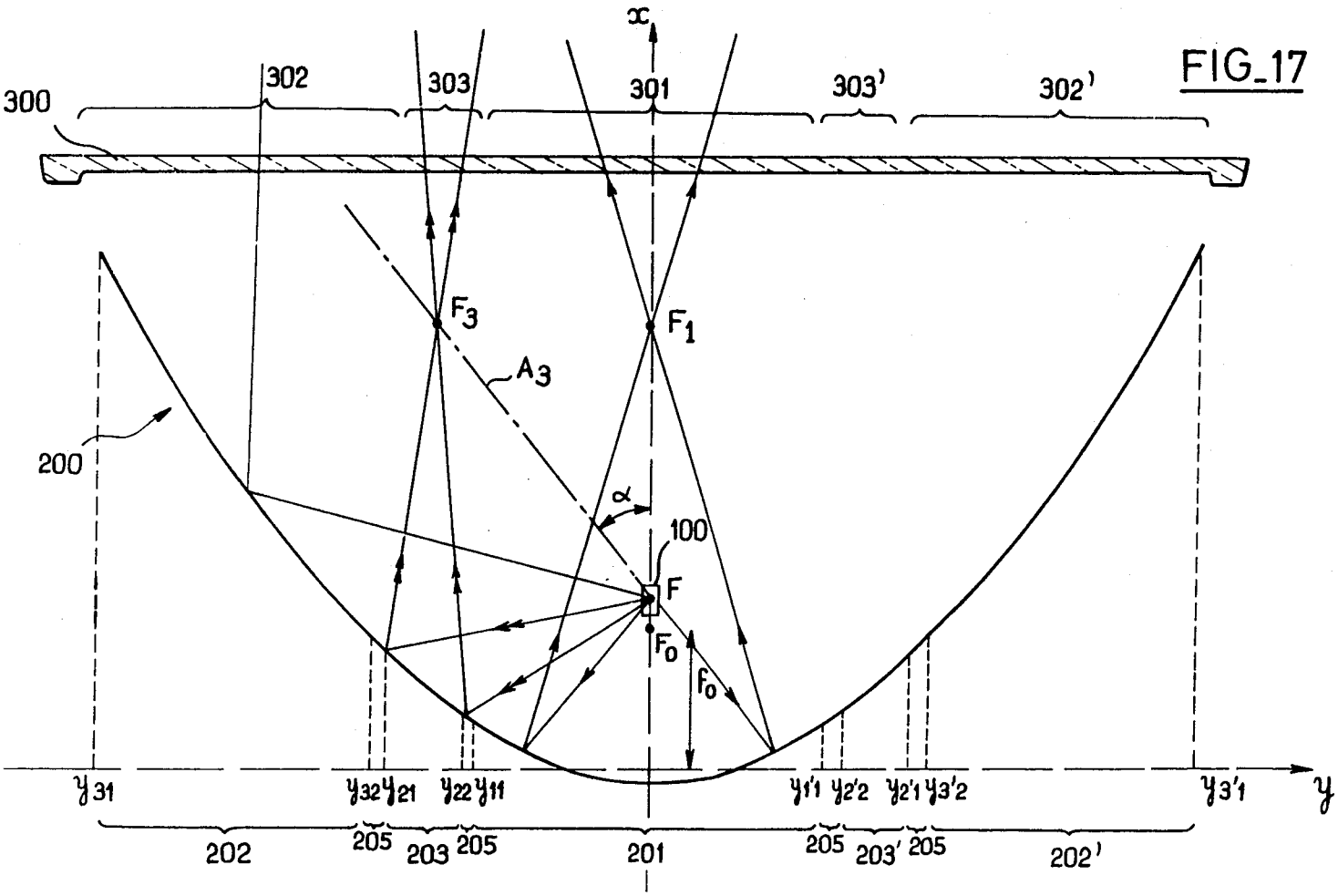
FIG. 17 is a diagrammatic horizontal section through a headlight constituting a third basic embodiment of the present invention.

FIG. 17 shows a headlight in accordance with a third basic embodiment of the invention. It comprises a filament 100 represented by an elongate cylinder whose axis lies on the optical axis Ox of the headlight, a reflector 200, and a front closure glass 300.

The reflector 200 is represented by its horizontal generatrix line in the horizontal axial plane xOy, and this generatrix line is divided into five zones: 201, 202, 202', 203, and 203' which join along vertical axial transition planes.

The two opposite-side zones 202 and 202' are portions of a parabola having a focal length $f_0$ and having a focus $F_0$ situated on the optical axis Ox slightly behind the filament 100.

This parabola can be defined using the following parametric equation:

$$(11)\begin{cases} x = f(t) = t_2/4f_0 & \text{with } t \text{ varying over} \\ & [y_{31}, y_{32}] \text{ or } [y'_{31}, y'_{32}] \\ y = g(t) = t \end{cases}$$

The two intermediate zones 203 and 203' situated immediately inside the outer zones 202 and 202' are each defined as a respective portion of an ellipse having respective major axes $A_3$ and $A'_3$ (where $A_3$ is the only one shown in the figure), with said major axes being at a considerable outward slope (in the emission direction) at an angle referenced $\alpha$.

The first focus F common to both inclined ellipses is situated in the center of the filament, and the second focuses of the ellipses marked $F_3$ and $F'_3$ respectively are situated at a substantial distance behind the closure glass 300 (with only the focus $F_3$ being shown in the figure).

Mathematically speaking, the equation of the ellipse is $(X^2/A^2)+(Y^2/B^2)=1$ in a frame of reference [0, X, Y] where Ox is the major axes of the ellipse in question. There is no point in transforming this equation to the previously-mentioned frame of reference where Ox is the optical axis of the headlight. It is merely noted that the parameters A and B are easily obtained from the co-ordinates of the two focuses F and $F_3$ of the ellipse with F being selected as mentioned above and with $F_3$ being selected so as to be situated at a substantial distance behind the glass, while simultaneously facing the zone 202 of the reflector. It is merely observed that:

$$(12)\begin{cases} x = f(t) & \text{in the intervals} \\ y = g(t) & [y_{21}, y_{22}] \text{ and } [y'_{22}, y'_{21}] \end{cases}$$

Finally, the central zone 201 of the horizontal generatrix line of the reflector 200 is a portion of an ellipse whose major axes coincides with the optical axis Ox, whose first focus F is situated in the center of the filament 100, and whose second focus $F_1$ is situated, in the present example, at a substantial distance behind the closure glass 300, as shown.

This ellipse is defined by the following parametric equation:

$$(13)\begin{cases} x = f(t) = a \cdot (1 - \sqrt{1 - t^2/b^2}) \\ y = g(t) = t & \text{with } t \in [y_{11}, y'_{11}] \end{cases}$$

Where the various zones of the reflector do not join, directly, with second order continuity, they are interconnected by third-degree smoothing curves which the person skilled in the art is capable of calculating easily. The smoothing curves (zones 205) have the property of providing first and second order continuity between the various main zones of the horizontal generator line without creating significant anomalies in the light rays reflected from said transition zones.

From the above parametric equations (11) to (13), one possible definition of the reflector 200 overall in the orthogonal frame of reference [O, x, y, z], and as shown is as follows:

$$\left.\begin{aligned} x &= f(t) + \frac{2f'(t)g'(t)[g(t) - y_F] + [f'(t)^2 - g'(t)^2] \cdot (f(t) - x_F)}{4[g'(t)(f(t) - x_F) - f'(t)(g(t) - y_F)]^2} \cdot z^2 \\ y &= g(t) + \frac{2f'((t)g'(t)[f(t) - x_F] - [f'(t)^2 - g'(t)^2] \cdot (g(t) - y_F)}{4[g'(t)(f(t) - x_F) - f'(t)(g(t) - y_F)]^2} \cdot z^2 \\ z &= z \end{aligned}\right\}(14)$$

where:

t varies over the range $[y_{31}, y'_{31}]$; and $(x_F, y_F)$ are the co-ordinates in the plane (O, x, y) of an imaginary point which, as explained in greater detail below, determines the extent to which the overall surface of the reflector is concave following its vertical generatrix lines.

As can be seen in FIG. 17, the various parameters ($F_0$, F, $F_1$, $F_2$, and $\alpha$) which have an effect on the shape of the horizontal generatrix line of the reflector 200 are determined in such a manner that the light beams provided by the various zones of said generatrix line pass through the closure glass 300 in corresponding zones 301, 302, 302', 303, and 303' which are juxtaposed and distinct from one another.

Further, it is clear that the size of a filament image generated by the reflector is a function of the distance between the filament and the point which generates the image.

Thus, it will be understood that the central zone 201 generates relatively large images of the filament, while the intermediate zones 203 and 203' form intermediate size images, and the outer zones 202 and 202' form small images. More particularly, an auxiliary feature of this embodiment of the invention lies in the fact that specific zones of the glass have a one-to-one correspondence with images of given size and substantially without mutual overlap, thereby making it possible to use the glass 300 to perform various corrections or adjustments of specific light beam components without degrading the other components thereof, as described in greater detail below.

The horizontal generatrix line and equation (14) described above make it possible to create reflectors which are adapted to various different types of headlight such as those defined in the introduction.

Firstly, if $x_F=f_0$ and $y_F=0$, the above-mentioned imaginary point then coincides with the focus $F_0$ of the parabolic zones 202 and 202' and equation (14) becomes:

$$\left.\begin{aligned} x &= f(t) + \frac{2f'(t)g'(t)g(t) + [f'(t)^2 - g'(t)^2][f(t) - f_0]}{4[g'(t)(f(t) - f_0) - f'(t)g(t)]^2} \cdot z^2 \\ y &= g(t) + \frac{2f'(t)g'(t)[f(t) - f_0] - [f'(t)^2 - g'(t)^2]g(t)}{4[g'(t)[f(t) - f_0] - f'(t)g(t)]^2} \cdot z^2 \end{aligned}\right\} \quad (15)$$

$$z = z$$

It can be shown that in the zones 202 and 202' this equation defines a paraboloid of revolution having focus $F_0$ and focal length $f_0$.

Further, in the zone 201, the reflecting surface has an axial horizontal generatrix line which is an ellipse as described above and an axial vertical generatrix line (y=0) which is a parabola.

Like the reflectors shown in FIGS. 1 to 4 and 7 and 8, such a reflector is intended to form a dipped beam satisfying the European standard in conjunction with a filament having a masking cup such as that provided in standardized "H4" lamp.

Figure 18:
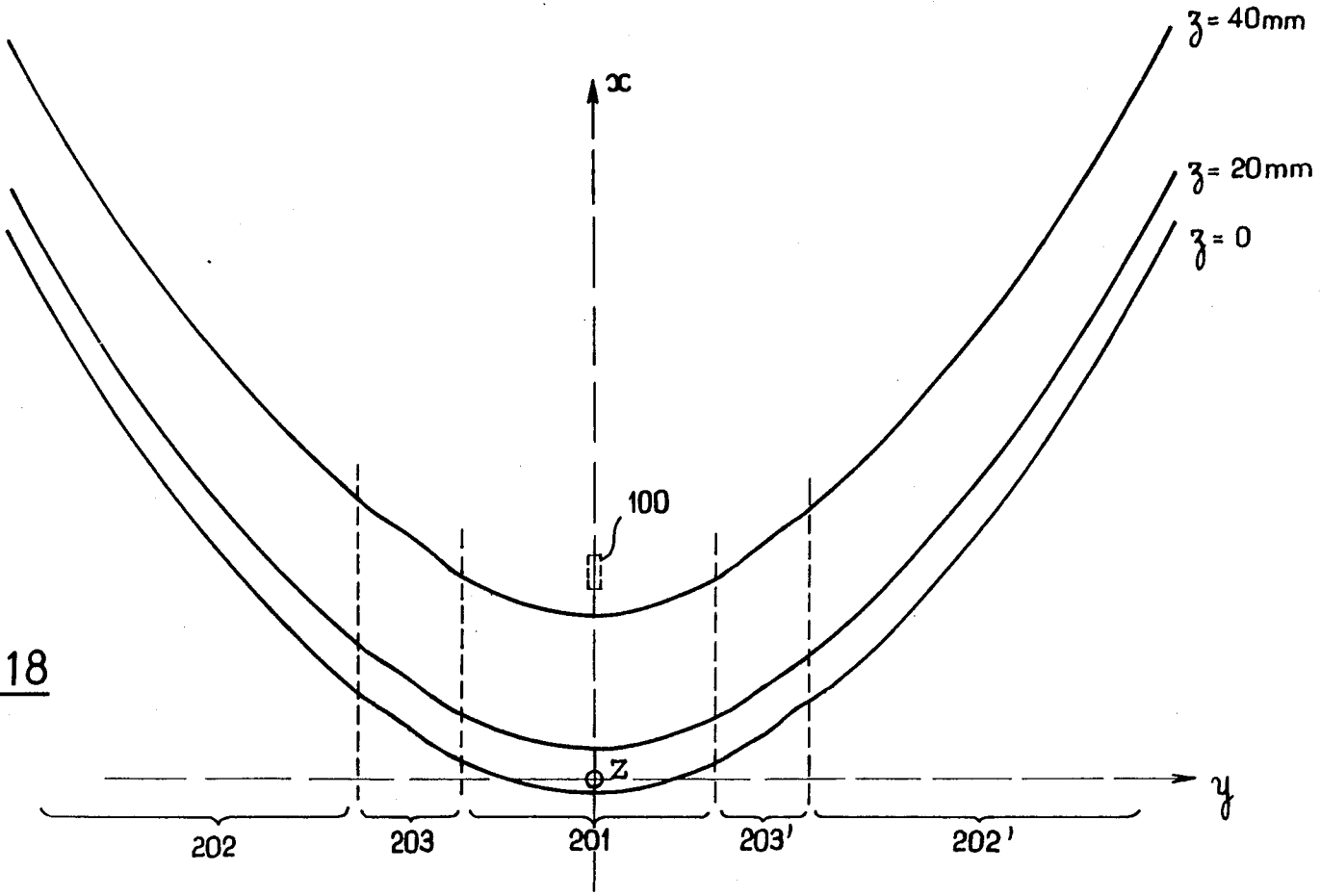
FIG. 18 shows a plurality of horizontal generatrix lines corresponding to different heights of the reflector of the headlight shown in FIG. 17.

FIG. 18 shows a set of horizontal sections through the reflector as projected on the xOy plane, with the sections being taken at the following heights, z=0, z=20 mm, and z=40 mm.

The reflector shown has the following parameters:

*$f_0$=26.5 mm
*$y_{11}=y'_{11}$=33.9 mm
*$y_{21}=y'_{21}$=50 mm
*$y_{31}=y'_{31}$=105 mm
*$y_{F1}$=116.5 mm
$y_{F1}$=0
*$y_{F3}$=+141.8 mm
$y_{F3}$=−22.7 mm

Figure 19A:
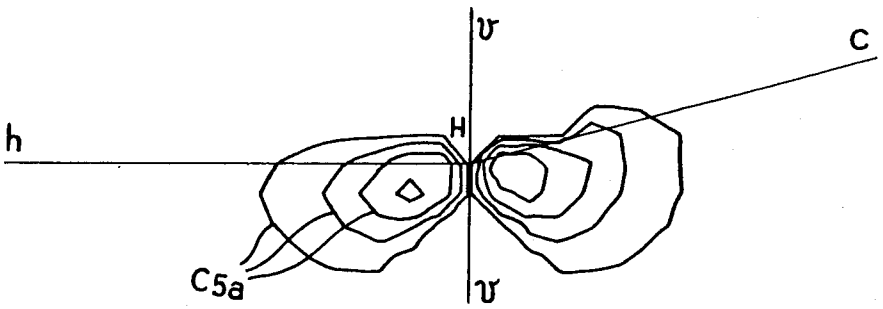
FIGS. 19*a*, 19*b*, and 19*c* are respective sets of isocandela curves showing the illumination provided by specific zones associated with the FIG. 18 reflector in the absence of its closure glass and in association with one of its filaments.
Figure 19B:
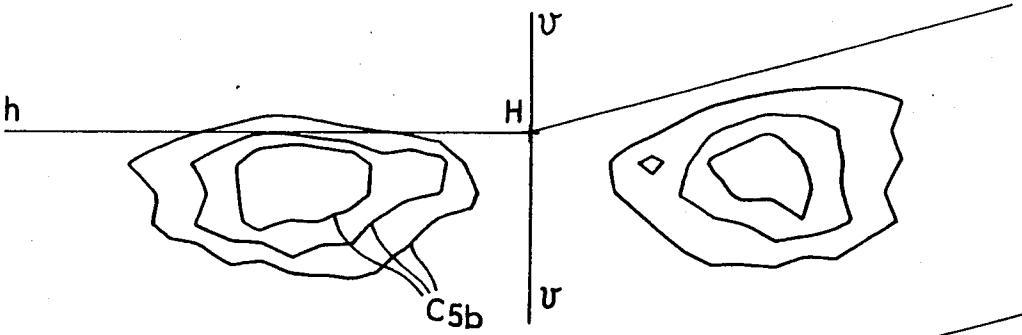
Figure 19C:
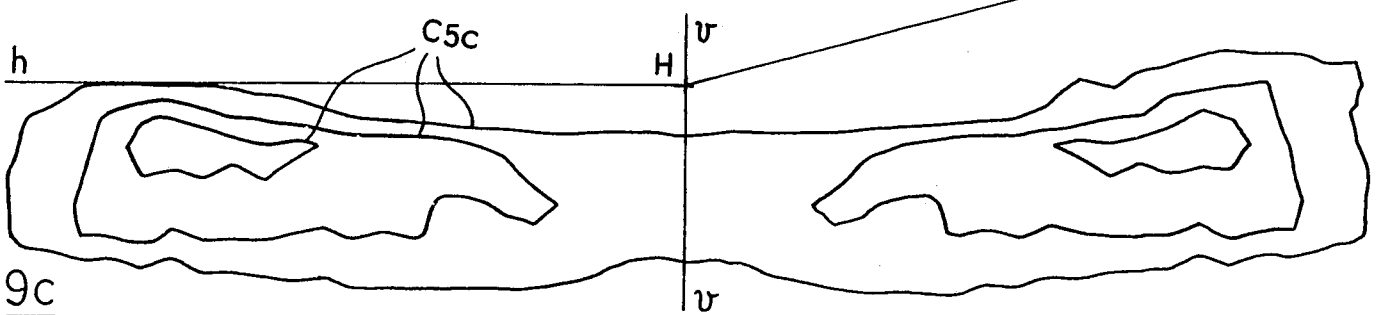

FIGS. 19a to 19c are sets of isocandela curves $C_{5a}$ to $C_{5c}$ showing the illumination on a standardized projection screen at 25 meters (m) as provided respectively by the portions 202–202', 203–203', and 201 of the above-defined reflector, using a masked filament and in the absence of the closure glass 300.

Thus, the illumination shown in FIG. 19a is obtained with small-sized filament images formed at the edges of the reflector and constituting a beam concentration spot with the cut-off line beginning quite adequately.

The illumination in FIG. 19b is provided by intermediate sized filament images created by the intermediate zones 203 and 203', thereby giving the medium width of the beam. The cut-off line hHc is extended sideways.

Finally, FIG. 19c shows the illumination provided by the large filament images created by the central zone 201 of the reflector which has the elliptical horizontal generatrix line, giving rise to the wide portions of the beam. In addition to this advantage, it is recalled that the central zone 201 has the further advantage, in accordance with the invention, of focusing the light rays it reflects substantially behind the glass 300 (point $F_1$) in order to avoid overheating it centrally, thereby making it possible to use a glass made of plastic.

It is mentioned above that the various zones of the reflector correspond on a one-to-one basis with a corresponding associated zones of the glass. This means that it is possible to act on some portions of the beam (concentrated portion, intermediate width portion, wide portion) without affecting the other portions.

In particular, this makes it possible, for example by providing suitable slightly deflecting prisms or ribs on specific zones of the glass, either to adjust the distribution and the shape of the beam, or else to cause the various illuminated fields coming from the various portions of the reflector to overlap so as to make the overall beam as homogeneous as possible.

However, it has been observed that the illumination provided by the entire reflector in the absence of any closure glass already has the required qualities of width and uniformity without requiring any correction.

The illumination provided by the above-described reflector when used in combination with the other, non-masked filament of the above-mentioned H4 lamp, i.e. the main beam filament, turns out to be entirely satisfactory. This main beam has the photometric characteristics required, and in particular it has a high degree of concentration on the axis and it is of substantial width.

In practice, the possibility of exploiting the rays from the rear of the reflector usefully in a reflector of this type, i.e. when there is no non-plated portion of the reflector or the like, makes it possible to use an "H4" type lamp, for example, with a reflector of relatively low height (about 90 mm) without excessively degrading the beam.

A second practical example of this third embodiment of the invention consists in selecting:

*for $z>0$, $x_F=x_1$ and $y_F=0$

*for $z<0$, $x_F=x_2=y_F=0$ where $x_1$ is the distance between the point O and the vicinity of the rear end of the filament 100 (point $P_1$) and $x_2$ is the distance between the point O and a point $P_2$ which is situated slightly in front of the filament 100.

In order to avoid overloading the description, the resulting surface equation is not given but it is easily derived from equation (14) above replacing ($x_F$, $y_F$) by ($x_1$, 0) for $z>0$, and by ($x_2$, 0) for $z<0$, with $x=f(t)$ and $y=g(t)$ for $z=0$.

It can easily be shown that for the outer zones 202 and 202', this equation defines a complex surface similar to that described in the present Assignees' French patent application No. 85/08655 which is intended to locate all of the filament images beneath the axial horizontal plane on line hh.

It can also be shown that the surface of the central zone 201 has a horizontal generatrix line which is an ellipse, as defined above, with vertical generatrix lines constituted by two juxtaposed half-parabolas, with focuses respectively at $P_1$ (for $z>0$) and $P_2$ (for $z<0$).

Finally, the intermediate zones 203 and 203' provide continuous transitions between the above-mentioned zones and also constitute a specific portion of the beam.

Figure 20:
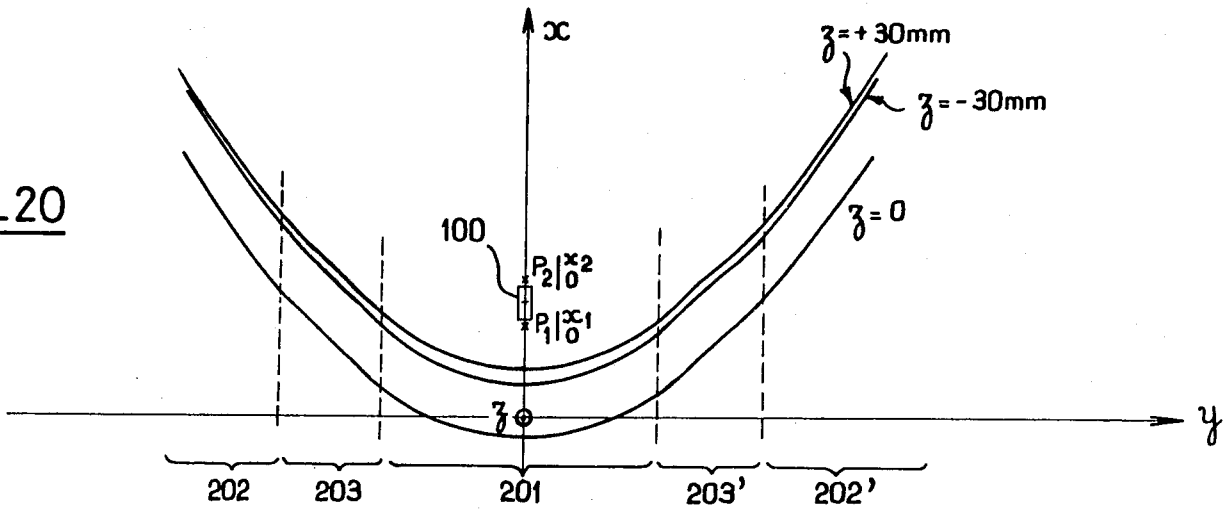
FIG. 20 shows a plurality of horizontal generatrix lines corresponding to different heights through the reflector of a headlight in accordance with a fourth main embodiment of the present invention.

FIG. 20 show horizontal sections through a practical embodiment of the reflector as projected on the horizontal plane xOy, with said sections being taken at the following different heights, z=0, z=−30 mm, and z=+30 mm.

The following parameters were used:

$*f_0 = 19$ mm $*x_1 = 15.65$ mm $*x_2 = 22.05$ mm $y_{11} = y'_{11} = 31.3$ mm $*y_{21} = y'_{21} = 50$ mm $*y_{31} = y'_{31} = 57$ mm $*x_{F1} = 109$ mm; $y_{F1} = 0$ $*x_{F3} = 300$ mm; $y_{F3} = -7.65$ mm

Figure 21:
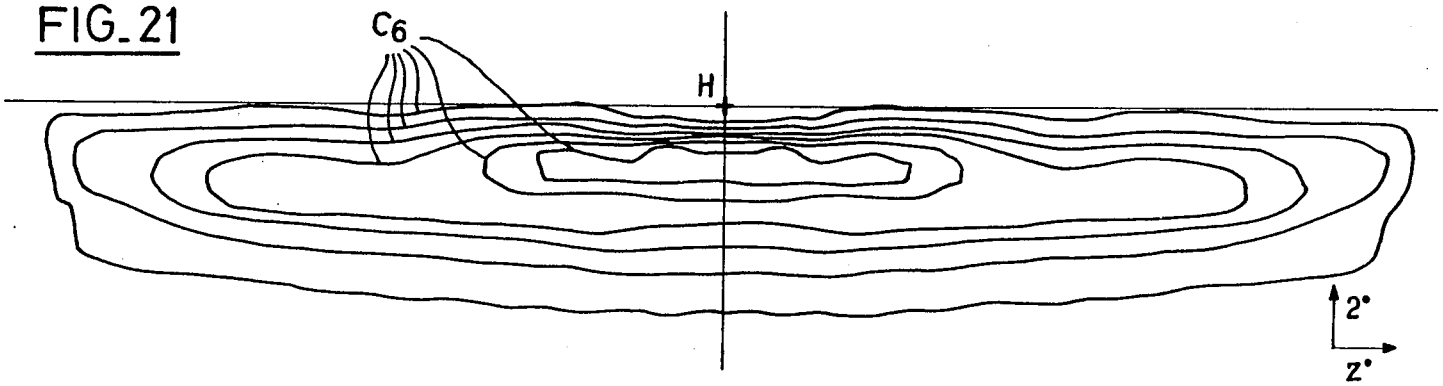
FIG. 21 is a set of isocandela curves showing the illumination provided by a headlight fitted with the FIG. 20 reflector and in the absence of its closure glass.

FIG. 21 shows a set of isocandela curves $C_6$ representative of the illumination provided by a headlight incorporating such a reflector and without its closure glass. It may be observed, in particular, that the modification of the rear zone of the reflector (zones 201, 203, and 203') compared with the prior art complex surface does not degrade the horizontal cut-off at all, indeed it extends it sideways with excellent accuracy. Further, as mentioned, the surface of the reflector is second order continuous.

This continuous surface is particularly suitable for a foglight in accordance with the European standard or the American standard and there is no need to provide the vertical deflector prisms on the closure glass 300 that used to be necessary, nor is there any need to provide beam-spreading prisms or rips since the beam is already spread wide enough.

As shown in detail below, this combined horizontal and vertical positioning of the filament images makes it possible to use a highly sloping glass which is frequently required for aerodynamic reasons or for reasons of appearance.

However, it must naturally be understood that the abovedescribed surface can also be advantageously used for a dipped beam headlight having the American cut-off (as described in the introduction).

Thus, all reflectors in accordance with the invention are advantageous in that they avoid overheating the middle of the closure glass, thereby making it easy to make the closure glass out of transparent plastic material.

However, this type of reflector is also entirely applicable for use with a steeply sloping closure glass, in particular one that follows an aerodynamic profile at the front of the vehicle. It is well known that the deflection of light rays performed by prisms or ribs provided on such a steeply sloping glass gives rise to unwanted light anomalies and in particular to the light rays being downwardly deflected by an amount which is essentially proportional to the amount they are deflected sideways. This problem is explained, in particular, in the present Assignees' published French patent application No. 2 542 422.

In accordance with the present invention, since all of the above-described reflectors provide a beam (be that the dipped beam or the main beam) which is already widely spread in the sideways direction upstream from the closure glass (see FIGS. 5, 14, and 21), the amount of lateral deflection required by the closure glass is reduced and the unwanted downwards deflection mentioned above is greatly attenuated.

Naturally, the invention is not limited to the embodiments described and shown, and the person skilled in the art can easily make variations or modifications thereto without going beyond its scope.

Thus, although preferred equations have been given by way of example for the reflecting surface of the central zone and of the intermediate zones, naturally any other equation which would give rise to a change in beam convergence while still providing second order continuity where it joins the side zones or the intermediate zones, will be suitable.

Further, it should be mentioned that the various abovementioned patent applications in the name of the present Assignees, are mentioned for reference purposes and the variant embodiments described therein could also be modified in accordance with the teaching of the present invention.

We claim:

1. A motor vehicle headlight of the type suitable for emitting at least one beam that is delimited by a top cut-off and that includes an approximately central concentration spot, the headlight comprising: a filament lamp; a reflector; and an enclosure glass; the headlight including the improvements whereby said reflector comprises:

at least two lateral zones that form small images of the filament defining said concentration spot and forming said cut-off; and a central zone which reflects the light rays emitted by the filament to cause them to converge in a region at a substantial distance from the closure glass while simultaneously forming large filament images which are spread out below said cut-off;

with said lateral zones and said central zone joining one another with second order continuity in two essentially vertical planes that are parallel to a central optical axis of the headlight and are disposed on either side thereof.

2. A headlight according to claim 1, of the type suitable for delivering a main beam and a dipped beam limited by said cut-off, and including two axially aligned filaments on the optical axis of the headlight serving as respective light sources for said main beam and for said dipped beam, wherein said lateral zones of the reflector are portions of paraboloids whose focuses are situated on the optical axis between said two filaments.

3. A headlight according to claim 2, wherein the central zone is symmetrical on either side of the vertical axial plane through the headlight, and wherein the lateral zones are portions of the same paraboloid.

4. A headlight according to claim 2, wherein the central zone comprises two portions situated on either side of the axial vertical plane through the headlight with the surfaces of said two zones being different from each other, and wherein the said lateral zones are portions of two paraboloids having different focal lengths.

5. A headlight according to claim 4, wherein said two portions of the central zone join in the vertical axial plane through the projector with first order continuity.

6. A headlight according to claim 4, wherein said central zone further includes a joining portion situated between said portions and serving to provide second order continuity joining between said portions.

7. A headlight according to claim 2, wherein said central zone has an apex which is offset sideways from the apex of the paraboloids of which said lateral zone constitute portions.

8. A headlight according to claim 1, of the type giving a dipped beam or a fog beam delimited by a cut-off and having an axial filament emitting freely in all directions thereabout and disposed in the vicinity of the optical axis of the headlight, wherein said lateral zones of the reflector are zones for creating images of the filament whose topmost points lies in the vicinity of said cut-off.

9. A headlight according to claim 8, wherein the reflector is symmetrical on either side of the vertical axial plane through the headlight.

10. A headlight according to claim 8, wherein said central zone of the reflector comprises two portions situated on either side of the axial vertical plane through the headlight with the surfaces of the left and right portions thereof being governed by the same equation but having different parameters in said left and right portions.

11. A headlight according to claim 10, wherein said two lateral zones are governed by a single equation having different parameters for the left and right lateral zones.

12. A headlight according to claim 10, wherein said left and right portions of said central zone join in the axial vertical plane of the headlight with first order continuity.

13. A headlight according to claim 10, wherein said central zone further includes a joining portion situated between said left and right portions and serving to join said left and right portions with second order continuity.

14. A headlight according to claim 8, wherein said central zone has an apex which is offset sideways relative to the apexes of the surfaces of which the lateral zones constitute portions.

15. A headlight according to claim 2, wherein said central zone of said reflector comprises a rear zone whose axial horizontal generator line is a portion of an ellipse having a first focus situated in the vicinity of the dipped beam filament and whose second focus is situated on the optical axis at a substantial distance from the closure glass, together with two intermediate zones situated between the rear zone and said lateral zones, with the respective axial horizontal generatrix lines of said two intermediate zones being portions of ellipses whose respective major axes are outwardly inclined and whose focuses are respectively situated in the vicinity of the filament and facing said intermediate zones at a substantial distance from said closure glass.

16. A headlight according to claim 8, wherein said central zone of said reflector comprises a rear zone whose axial horizontal generator line is a portion of an ellipse having a first focus situated in the vicinity of the dipped beam filament and whose second focus is situated on the optical axis at a substantial distance from the closure glass, together with two intermediate zones situated between the rear zone and said lateral zones, with the respective axial horizontal generatrix lines of said two intermediate zones being portions of ellipses whose respective major axes are outwardly inclined and whose focuses are respectively situated in the vicinity of the filament and facing said intermediate zones at a substantial distance from said closure glass.

17. A headlight according to claim 15 or claim 16, wherein second order continuity is provided by transition zones defined by smoothing curves.

18. A headlight according to claim 15 or claim 16, wherein said reflector zones are determined in such a manner as to ensure that there is substantially no overlap at the closure glass between the beam portions generated by different ones of said zones.

* * * * *